US006949322B2

(12) United States Patent
Lee et al.

(10) Patent No.: US 6,949,322 B2
(45) Date of Patent: Sep. 27, 2005

(54) COMPOSITION FOR FORMING OVERCOAT LAYER FOR ORGANOPHOTORECEPTOR USING POLYAMINOETHER AND ORGANOPHOTORECEPTOR EMPLOYING OVERCOAT LAYER PREPARED FROM THE COMPOSITION

(75) Inventors: Nam-Jeong Lee, Gyeonggi-do (KR); Saburo Yokota, Gyeonggi-do (KR); Kyung-Yol Yon, Gyeonggi-do (KR); Hwan-Koo Lee, Gyeonggi-do (KR); Hae-ree Joo, Seoul (KR); Beom-Jun Kim, Geyonggi-do (KR)

(73) Assignee: Samsung Electronics, Co., Ltd., Suwon-Si (KR)

( * ) Notice: Subject to any disclaimer, the term of this patent is extended or adjusted under 35 U.S.C. 154(b) by 108 days.

(21) Appl. No.: 10/444,141

(22) Filed: May 23, 2003

(65) Prior Publication Data

US 2003/0235431 A1 Dec. 25, 2003

(30) Foreign Application Priority Data

Jun. 24, 2002 (KR) ..... 10-2002-0035418

(51) Int. Cl.[7] ..... G03G 15/04; G03G 5/00
(52) U.S. Cl. ..... 430/66; 430/132; 399/159
(58) Field of Search ..... 430/66, 132; 399/159

(56) References Cited

U.S. PATENT DOCUMENTS 5,464,924 A * 11/1995 Silvis et al. ..... 528/102
5,834,147 A * 11/1998 Nagae et al. ..... 430/67
6,455,116 B1 * 9/2002 Xia et al. ..... 428/36.6
2003/0148098 A1 * 8/2003 Shafi et al. ..... 428/375

* cited by examiner

*Primary Examiner*—John L Goodrow
(74) *Attorney, Agent, or Firm*—Staas & Halsey LLP

(57) ABSTRACT

A composition forms an overcoat layer of an organophotoreceptor, the composition including polyaminoether and a solvent, and an organophotoreceptor employing the overcoat layer formed from the composition. The polyaminoether is represented by Formula 1:

Formula 1 wherein n is an integer from 10 to 400.

19 Claims, 3 Drawing Sheets

COMPOSITION FOR FORMING OVERCOAT LAYER FOR ORGANOPHOTORECEPTOR USING POLYAMINOETHER AND ORGANOPHOTORECEPTOR EMPLOYING OVERCOAT LAYER PREPARED FROM THE COMPOSITION

CROSS-REFERENCE TO RELATED APPLICATIONS

This application claims the benefit of Korean Application No. 2002-35418, filed Jun. 24, 2002, in the Korean Intellectual Property Office, the disclosure of which is incorporated herein by reference.

BACKGROUND OF THE INVENTION

1. Field of the Invention

The present invention relates to a composition to form an overcoat layer for an organophotoreceptor and an organophotoreceptor employing an overcoat layer prepared from the composition. More particularly, the invention relates to a composition for forming an overcoat layer constituting an outermost layer of an organophotoreceptor to form an electrophotographic image, and an organophotoreceptor having good electrical and wear resistance by employing the overcoat layer prepared from the composition.

2. Description of the Related Art

In electrophotography, an organophotoreceptor includes a photosensitive layer formed on a conductive base and is in the form of a plate, disk, sheet, belt, or drum.

The principles of electrophotographically forming an image are briefly described below.

First, the surface of the organophotoreceptor is electrostatically uniformly charged and irradiated with a laser beam. Positive and negative charges are generated at portions into which a laser beam is irradiated and migrate to the surface. As the surface charges are neutralized, the surface potential in an exposed area is changed so that a latent image is formed.

Thereafter, when the latent image is developed with a toner, a visible image is formed on the surface of the organophotoreceptor. The formed image is transferred to the surface of a receiver, such as paper. The imaging process is repeated.

Both single layer and multilayer photoconductive elements have been used. In the single layer embodiment, a charge transport material and a charge generating material are combined with a polymeric binder, and then are deposited on the conductive base. In the multilayer embodiment, the charge transport material and charge generating material are in the form of separate layers, each of which is optionally combined with a polymeric binder and is deposited on the conductive base. Two arrangements are possible. In one arrangement (the "dual layer" arrangement), the charge generating layer is deposited on the conductive base, and the charge transport layer is deposited on top of the charge generating layer. In an alternate arrangement (the "inverted dual layer" arrangement), the order of the charge transport layer and charge generating layer is reversed.

In both the single and the multilayer photoconductive elements, the purpose of the charge generating material is to generate charge carriers (i.e., holes and electrons) upon exposure to light. The purpose of the charge transport material is to accept these charge carriers and transport them through the charge transport layer to discharge a surface charge on the photoconductive element.

In general, the photoreceptor easily wears due to friction against a toner, a roller or a cleaning blade during an imaging process, so that the thickness thereof decreases and the life thereof is shortened. Thus, an overcoat layer is coated on the organophotoreceptor.

In recent years, development of electrophotographic printers using a wet-type toner is underway, and there is an increasing demand to develop organophotoreceptors for a wet-type toner. Conventional compositions to form overcoat layers generally aim to extend a lifetime of organophotoreceptors suitable for a dry-type toner. That is to say, currently, development of compositions to form overcoat layers suitable for a wet-type toner is not yet actively being carried out.

An organophotoreceptor should not affect image quality adversely, which is caused by an increase of a charge potential and a decrease of an exposure potential or residual potential due to electrical or mechanical fatigue of the organophotoreceptor during printing through repeated charge-exposure-discharge cycles.

However, an organophotoreceptor with an overcoat layer unavoidably experiences the above-cited problem, compared to an organophotoreceptor without an overcoat layer. To avoid the problem, the thickness of an overcoat layer is restricted. If a thin overcoat layer is used, the coated layer may be easily worn due to friction between the layer and a cleaning blade in the presence of a wet-type toner, or scratches may be generated due to the toner or foreign matter, adversely affecting image quality.

SUMMARY OF THE INVENTION

The present invention provides a composition to form an overcoat layer for an organophotoreceptor with improved electrical properties and wear resistance.

The present invention also provides an organophotoreceptor having an extended lifetime by employing a suitable overcoat layer using the composition of the present invention to form an overcoat layer.

The present invention also provides an electrophotographic imaging method using a wet-type toner, in which the organophotoreceptor is used to have suitable resistance against the wet-type toner.

In accordance with an aspect of the present invention, a composition comprising polyaminoether and a solvent is used to form an overcoat layer for an organophotoreceptor.

The polyaminoether is represented by Formula 1:

Formula 1

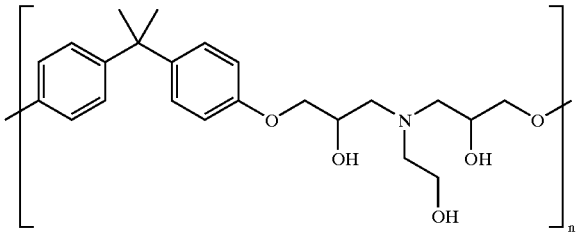

wherein n is an integer from 10 to 400.

In accordance with another aspect of the present invention, an organophotoreceptor comprises a conductive base, a photosensitive layer formed on the conductive base, and an overcoat layer formed on the photosensitive layer and having a product obtained by coating an overcoat layer forming composition comprising polyaminoether and a solvent, and drying the resultant product.

In accordance with another aspect of the present invention, an electrophotographic imaging process is used to develop of the organophotoreceptor according to the present invention.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
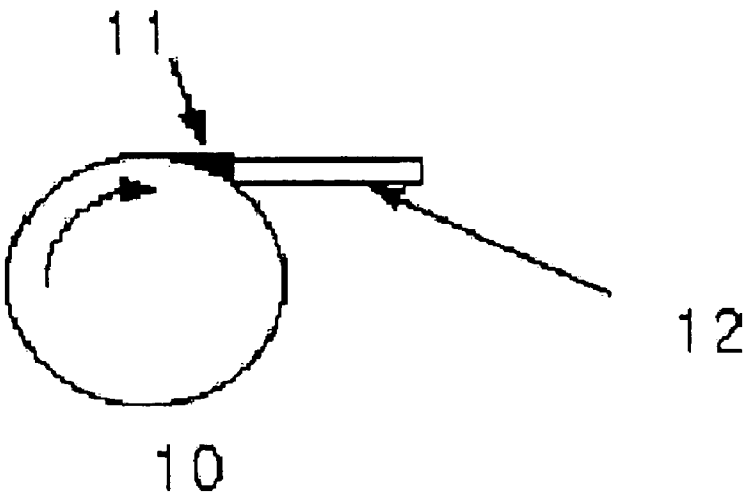
FIG. 1 is a schematic diagram of a wear resistance evaluating apparatus used for evaluating wear resistance of organophotoreceptors according to Examples 1 through 3 and Comparative Example 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figure.

The present invention is directed to an organophotoreceptor having improved life characteristics by forming an overcoat layer having enhanced electrical properties and wear resistance using polyaminoether. The polyaminoether is a polymer having efficient oxygen penetration resistance and is preferably a compound represented by Formula 1:

Formula 1

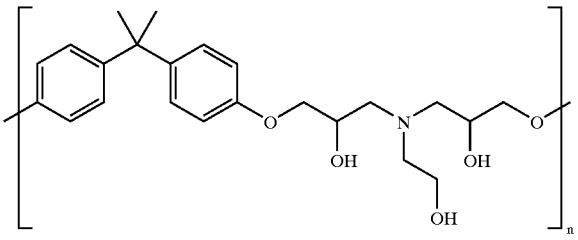

wherein n is an integer from 10 to 400.

A weight average molecular weight of the polyaminoether represented by Formula 1 is preferably in the range of 4,000 to 160,000.

The overcoat layer forming composition according to the present invention includes polyaminoether represented by Formula 1 and a solvent.

As the solvent, any solvent that dissolves polyaminoether may be used, and useful examples thereof include at least one selected from the group consisting of 1-methoxy-2-propanol, ethanol, butanol, methanol and isopropanol. Specifically, 1-methoxy-2-propanol is preferably used alone, or a cosolvent containing 1-methoxy-2-propanol and at least one alcoholic solvent selected from the group consisting of ethanol, butanol, methanol and isopropanol may be used. The total amount of the solvent is preferably 900 to 9900 parts by weight based on 100 parts by weight of the polyaminoether. If the amount of the solvent is less than 900 parts, an overly thick overcoating layer is formed, resulting in a high exposure potential and a sharp increase in residual potential and exposure potential during charge-exposure-discharge cycles. If the amount of the solvent is greater than 9900 parts, too thin a coating layer is formed, resulting in mechanical weakness so that the overcoat layer may be easily worn. When a cosolvent of 1-methoxy-2-propanol and an alcoholic solvent are used, the alcoholic solvent is preferably used in an amount of 1 to 30 parts by weight per 100 parts by weight of the total amount of the solvent.

A method of manufacturing an electrophotographic organophotoreceptor using the overcoat layer forming composition according to the present invention is described below.

Figure 2:
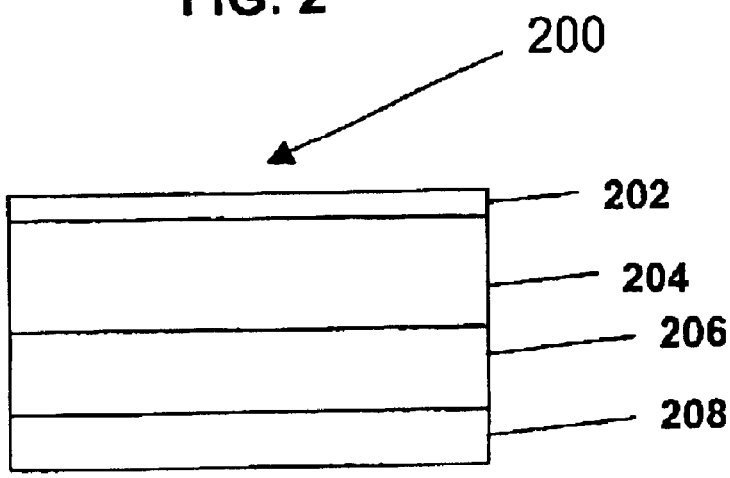
FIG. 2 is a schematic diagram (not to scale) of an electrophotographic organophotoreceptor using the overcoat layer forming composition in accordance with an embodiment of the present invention.
Figure 3:
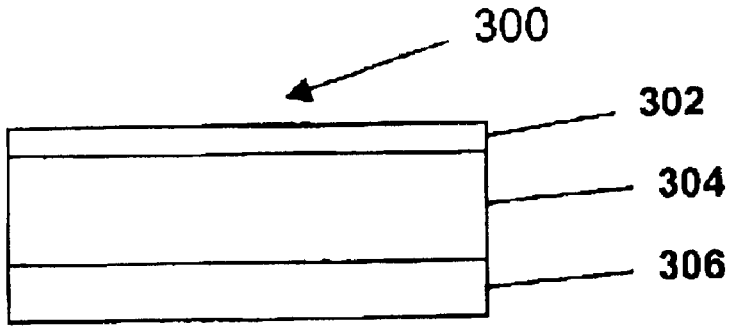
FIG. 3 is a schematic diagram (not to scale) of an electrophotographic organophotoreceptor using the overcoat layer forming composition in accordance with another embodiment of the present invention.

As shown in FIG. 2, first, an electrophotographic organophotoreceptor 200 may have a photosensitive layer formed on a conductive base 208. The photosensitive layer may be formed by sequentially stacking a charge transport layer 204/206 containing a charge transport material, and a charge generating layer 206/204 containing a charge generating material, or stacking the layers in the reverse order, and coating with an overcoat layer 202 in accordance with the present invention. Otherwise, as shown in FIG. 3, an electrophotographic organophotoreceptor 300 may have a photosensitive layer comprising a single layered structure 304 containing a charge transport material and a charge generating material formed on the conductive base 306 and coated with an overcoat layer 302 in accordance with the present invention.

The charge transport layer is formed by coating a composition including a charge transport material, a binder and an organic solvent and drying the resultant structure. The charge generating layer is formed by coating a composition including a charge generating material, a binder and an organic solvent, and drying the resultant structure.

Examples of the charge transport material include a pyrazoline derivative, a fluorine derivative, an oxadiazole derivative, a stilbene derivative, a hydrazone derivative, a carbazole hydrazone derivative, polyvinyl carbazole, polyvinylpyrene and polyacenaphthylene, and examples of the charge generating material include metal-free phthalocyanine (e.g., PROGEN 1×-form metal-free phthalocyanine, ZENECA INC.), and metal phthalocyanine such as titanium phthalocyanine, copper phthalocyanine, oxytitanium phthalocyanine, or hydroxygallium phthalocyanine. The amounts of these materials are within the conventional range. In particular, the charge transport material is used in an amount of 35 to 65 parts by weight based on 100 parts by weight of the charge transport layer forming composition, and the charge generating material is used in an amount of 55 to 85 parts by weight based on 100 parts by weight of the charge generating layer forming composition.

The binder is capable of dissolving or dispersing the charge transport material or charge generating material, and examples thereof include polyvinylbutyral, polycarbonate, polystyrene-Co-butadiene, modified acryl polymer, polyvinylacetate, styrene-alkyd resin, soya-alkyl resin, polyvinylchloride, polyvinylidene chloride, polyacrylonitrile, polycarbonate, polyacrylic acid, polyacrylate, polymethacrylate, styrene polymer, alkyd resin, polyamide, polyurethane, polyester, polysulfone, polyether and combinations thereof. In particular, polycarbonate and polyvinylbutyral are used in the present invention. The binder is used in an amount of 15 to 65 parts by weight based on 100 parts by weight of the charge generating layer forming composition or charge transport layer forming composition.

Examples of the solvent used to form the charge transport layer forming composition and the charge generating layer forming composition include tetrahydrofuran, methylenechloride, chloroform, dichloroethane, trichloroethane, chlorobenzene, and acetate-based solvent, and the amount of the solvent is in the range of 70 to 99 parts by weight based on 100 parts by weight of solid content of the charge generating layer forming composition or charge transport layer forming composition.

The coating method of the charge generating layer forming composition and the charge transport layer forming is not limited, but ring coating or dip coating is preferred when the conductive base is in the form of a drum.

As described above, after forming a photosensitive layer on the conductive base, the overcoat layer forming composition according to the present invention is coated on the photosensitive layer and thermally treated to form an overcoat layer, thus completing the electrophotographic photoreceptor according to the present invention. The thermal treatment is preferably performed at a temperature in the range of 80 to 140° C., more preferably 100 to 130° C.

The overcoat layer forming composition may coated by spin coating, dip coating or ring coating, and ring coating or dip coating is preferred when the conductive base is in the form of a drum.

In the organophotoreceptor according to the present invention, the overall thickness of the photosensitive layer is in the range of 5.1 to 26 μm. Generally, the charge generating layer has a thickness of 0.1 to 1.0 μm, the charge transport layer has a thickness of 5 to 25 μm, and the conductive base, in particular, the drum substrate, has a thickness of 0.5 to 2 μm. The overcoat layer has a thickness of 0.1 to 10 μm. If the thickness of the overcoat layer is less than 0.10 μm, the overcoat layer does not protect the underlying layers effectively. If the thickness of the overcoat layer is greater than 10 μm, the electrical properties of the photoreceptor layer undesirably deteriorate. For example, the exposure potential of the overcoat layer may increase.

The organophotoreceptor according to the present invention may further include additional layers. Such additional layers are generally known layers, for example, a charge blocking layer. The charge blocking layer may be formed between the conductive base and the charge transport layer, improving adhesion therebetween.

In the electrophotographically imaging process using the organophotoreceptor, dry- or wet-type toner may be used.

In electrophotography, when the organophotoreceptor for conventional dry-type toner is applied to wet-type toner, and contacts a paraffinic solvent, which is one of the main components of the wet-type toner, the organophotoreceptor of the present invention may become cracked or crazed, or some components of the organophotoreceptor may be eluted.

On the other hand, since the organophotoreceptor according to the present invention has a high resistance to a paraffinic solvent, the organophotoreceptor of the present invention may be advantageously used in an electrophotographic imaging process using a wet-type toner, and the above-described problems can be avoided. Also, the organophotoreceptor according to the present invention has good wear resistance in the presence of a wet-type toner.

An electrophotographic imaging process using the organophotoreceptor is now described. The surface of the organophotoreceptor is electrostatically uniformly charged and the charged surface is exposed by irradiating light imagewise, thus forming an electrostatic latent image on the surface of the organophotoreceptor. Subsequently, the surface of the organophotoreceptor having the electrostatic latent image is directly contacted with a wet-type toner for development, and then a temporary image is formed to transfer the image onto the surface of a receptor, such as paper or a transport body.

The wet-type toner is manufactured by dispersing a colorant, a charge control agent and the like, in a solvent. Hydrocarbon-based solvents, including aliphatic hydrocarbons, e.g., n-pentane, hexane or heptane, alicyclic hydrocarbons, e.g., cyclopentane or cyclohexane, aromatic hydrocarbons, e.g., benzene, toluene or xylene, halogenated hydrocarbons, e.g., chlorinated alkane or chlorofluorocarbon, silicon oils or mixtures thereof may be used as the solvent. Specifically, aliphatic hydrocarbon solvents, in particular, branched paraffin solvent mixtures such as ISOPAR G, H, L, K, V or M, or NORPAR 12, 13, or 15 (Tradename) available from EXXON, are preferably used. The amount of the solvent is 5 to 100 parts by weight based on 1 part by weight of the colorant.

Useful colorants are well known in the art, and include materials such as dyes, stains, and pigments. Examples of suitable colorants include, but are not limited to, phthalocyanine blue (C.I. PIGMENT BLUE), monoarylide yellow, diarylide yellow, arylamide yellow, azo red, quinacridone magenta and black pigments, such as finely divided carbon, and the like.

Hereinafter, the present invention is described in greater detail with reference to the following examples. The following examples are for illustrative purposes and are not intended to limit the scope of the invention.

EXAMPLE 1

2 g of a hydrazone-based charge transport material (HCTM1, IMATION CO.) and 2 g of polycarbonate (PCZ 200, MITSUBISHI CHEMICAL CO.) were dissolved in 16 g of tetrahydrofuran, and filtered using a filter having a pore size of 1 μm, giving a charge transport layer forming composition.

The composition was coated on an aluminum photoreceptor drum at a speed of 300 mm/min using a ring coater, and dried to form a charge transport layer having a thickness of 8 μm.

0.84 g of polyvinylbutyral (BX-1, SEKISUI, Japan) was dissolved in 17.2 g of ethanol, and 1.96 g of titanyloxy phthalocyanine as a charge generating material (TiOPc, H. W. SANDS) was then added thereto, followed by mixing. The mixed solution was milled using an attritor-type milling machine for 1 hour, giving a dispersed solution.

To 4.29 g of the resulting dispersed solution were added 10.1 g of butylacetate and 0.63 g of ethanol for dilution, giving a charge generating layer composition. Subsequently, the charge generating layer composition was filtered using a filter having a pore size of 5 μm, and then coated on the charge transport layer at a speed of 250 mm/min using a ring coater, to form a charge generating layer having a thickness of 0.3 μm.

0.3 g of polyaminoether (BLOX 205, DOW CHEMICAL) having a number average molecular weight of approximately 60,000~70,000 and a weight average molecular weight of approximately 100,000, was dissolved in 9.7 g of 1-methoxy-2-propanol, giving an overcoat layer forming composition. The composition was coated on the charge generating layer using a ring coater at a speed of 200 mm/min and dried at 120° C. for 20 minutes, to form an overcoat layer having a thickness of approximately 1 μm, thus completing an organophotoreceptor.

EXAMPLE 2

An organophotoreceptor was manufactured in the same manner as in Example 1, except that in forming an overcoat layer forming composition, 0.2 g of polyaminoether (BLOX 205, DOW CHEMICAL) and 9.8 g of 1-methoxy-2-propanol (dowanol-PM) were used, and the overcoat layer had a thickness of approximately 0.5 μm.

EXAMPLE 3

An organophotoreceptor was manufactured in the same manner as in Example 1, except that in forming an overcoat layer forming composition, 0.1 g of polyaminoether (BLOX 205, DOW CHEMICAL) and 9.9 g of 1-methoxy-2-propanol (DOWANOL-PM) were used, and the overcoat layer had a thickness of approximately 0.3 μm.

Comparative Example 1

An organophotoreceptor was manufactured in the same manner as in Example 1, except that a 1.5% polyurethane dispersed solution (a cosolvent of ethanol and water mixed in a volume ratio of 1:1) was used as an overcoat layer forming composition, and an overcoat layer was formed by coating the composition and drying at 110° C. for 20 minutes.

Electrical properties, wear resistance and film states of the organophotoreceptors employing overcoat layers prepared in Examples 1–3 and Comparative Example 1 were evaluated by the following methods, and the results thereof are listed in Table 1.

(1) Electrical Properties

Electrical properties of the organophotoreceptors were evaluated by measuring changes in charge potential and exposure potential after repeating 100 times of charge-exposure-discharge cycling, using PDT2000 (QEA CO.) under conditions of a charge potential of 8 kV and exposure energy of 1 $\mu J/cm^2$.

(2) Wear Resistance

The organophotoreceptors were rotated using a wear resistance evaluating apparatus shown in FIG. 1 at a constant linear speed for 6 hours and were examined to determine whether scratches were generated. In FIG. 1, reference numeral 10 denotes an organophotoreceptor, reference numeral 11 denotes a wet-type toner and reference numeral 12 denotes a cleaning blade made of polyurethane. Here, the wet-type toner includes 2 parts by weight of a pigment, 10 parts by weight of a dispersing agent, 0.04 parts by weight of a charge control agent and 88 parts by weight of NORPAR 12.

(3) Film State

Occurrence of crack or craze was evaluated by the naked eye before and after dipping organophotoreceptors in NORPAR 12 for 48 hours.

TABLE 1

| Evaluation Item | Example 1 | Example 2 | Example 3 | Comparative Example 1 |
|---|---|---|---|---|
| Charge potential (V) | 537->545 | 527->532 | 518->522 | 515->521 |
| Exposure potential (V) | 112->119 | 110->115 | 106->109 | 103->115 |
| Scratching | X | X | Slight | Severe |
| Film state (Crack) | X | X | X | ○ |

As shown in Table 1, the organophotoreceptor prepared in Comparative Example 1 showed severe scratching during a wear resistance test using a wet-type toner and a great increase in exposure potential, and cracking occurred to the surface thereof after dipping in NORPAR, resulting in a damaged film state. In Examples 1–2, no scratch occurred, and there was a small change in exposure potential compared to the organophotoreceptor prepared in Comparative Example 1. The organophotoreceptor prepared in Example 3, which is thinner than the organophotoreceptors prepared in Examples 1–2, showed slight scratching, compared to the organophotoreceptors prepared in Examples 1–2, which is due to a difference in the thickness between the respective overcoat layers. An appropriate thickness of an overcoat layer was approximately 0.5–1 μm.

In the organophotoreceptors prepared in Examples 1–3, no cracking occurred after dipping in NORPAR 12, suggesting that the organophotoreceptors prepared in Examples 1–3 had good solvent resistance.

The organophotoreceptor according to the present invention has enhanced electrical properties and wear resistance. Also, in forming an electrophotographic image, a charge potential is reduced, and an increase in residual potential or exposure potential may be suppressed, leading to improved life characteristics. Also, the organophotoreceptor having high durability against a wet-type toner may be advantageously used for the wet-type toner.

Figure 4:
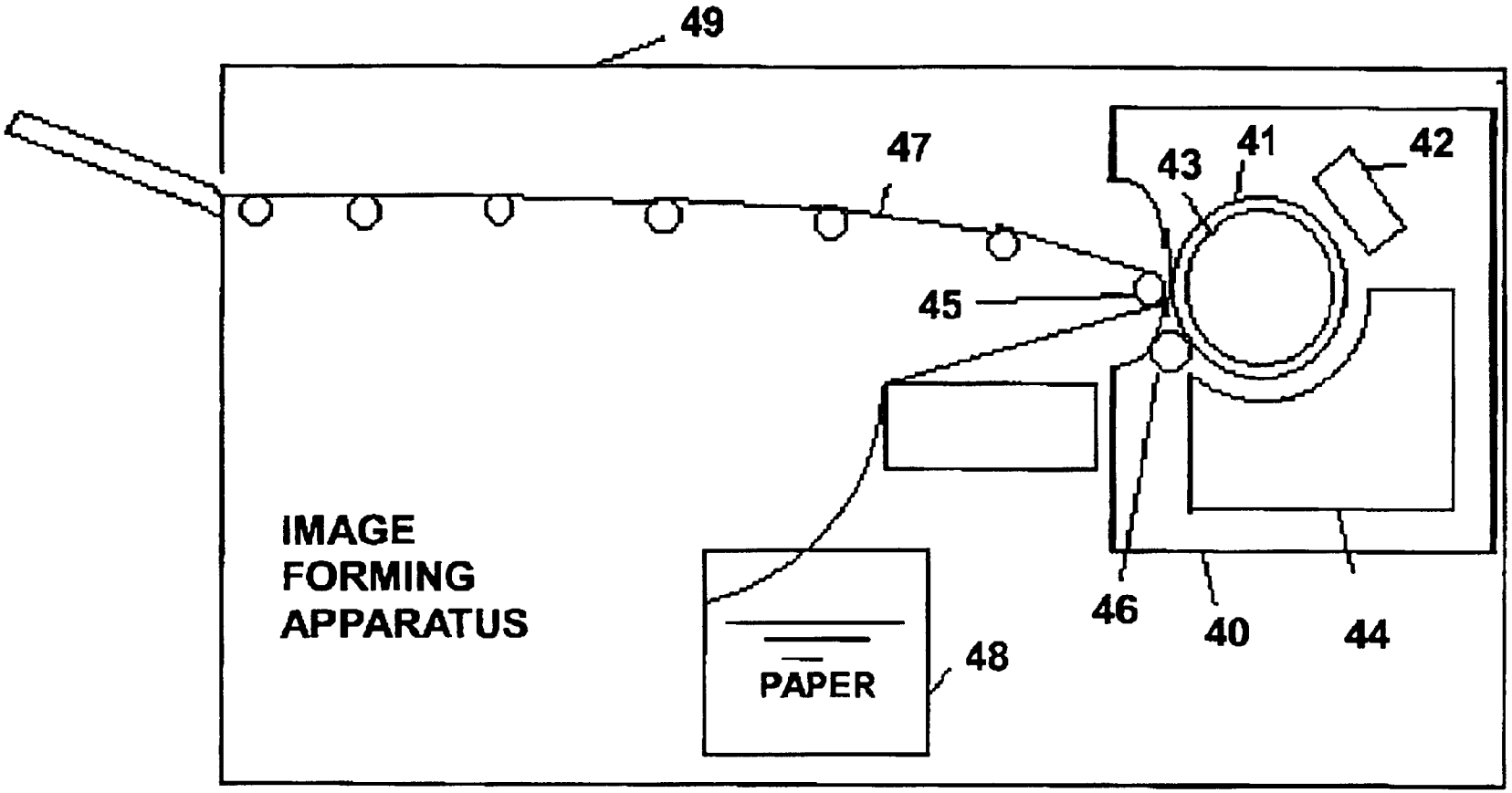
FIG. 4 is a schematic diagram (not to scale) of an electrophotographic organophotoreceptor using the overcoat layer forming composition, disposed on a drum of a cartridge of an image forming apparatus in accordance with the present invention.

As shown in FIG. 4, the present invention may be utilized in a organophotoreceptor cartridge 40, a organophotoreceptor drum 43, or in an image forming apparatus 49. The organophotoreceptor cartridge 40 typically comprises an electrophotographic organophotoreceptor 41 and at least one of a charging device 42 that charges the electrophotographic organophotoreceptor, a developing device 44 which develops an electrostatic latent image formed on the electrophotographic organophotoreceptor 41, and a cleaning device 46 which cleans a surface of the electrophotographic organophotoreceptor 41. The organophotoreceptor cartridge 40 is capable of being attached to and detached from the image forming apparatus 49, and the electrophotographic organophotoreceptor 41 is described more fully above.

The organophotoreceptor drum 43 for an image forming apparatus, generally includes a drum that is attachable to and detachable from the image forming apparatus and that includes an electrophotographic organophotoreceptor 41 installed thereon, wherein the electrophotographic organophotoreceptor 41 is described more fully above.

Generally, the image forming apparatus 49 includes a photoreceptor unit (e.g., an organophotoreceptor drum 43), a charging device 42 which charges the photoreceptor unit, an imagewise light irradiating device (not shown) which irradiates the charged photoreceptor unit with imagewise light to form an electrostatic latent image on the photoreceptor unit, a developing device 44 which develops the electrostatic latent image with a toner to form a toner image on the photoreceptor unit, a transfer device 45 which transfers the toner image onto a receiving material, e.g. paper 48, and a path 47 in which the receiving material 48 travels after the image has been formed, wherein the photoreceptor unit comprises a positively-charged electrophotographic organophotoreceptor 41 as described in greater detail above.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A composition to form an overcoat layer of an organophotoreceptor, the composition comprising polyaminoether and a solvent, wherein the polyaminoether is represented by the following Formula 1:

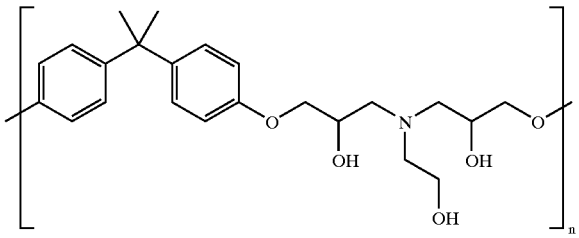

wherein n is an integer from 10 to 400, and wherein the solvent is in a range of 900 to 9900 parts by weight based on 100 parts by weight of the polyaminoether.

2. The composition of claim 1, wherein the weight average molecular weight of the polyaminoether represented by Formula 1 is in the range of 4,000 to 160,000.

3. The composition of claim 1, wherein the solvent is at least one selected from the group consisting of 1-methoxy-2-propanol, methanol, ethanol, propanol, butanol and isopropanol.

4. An organophotoreceptor comprising:

a conductive base;

a photosensitive layer formed on the conductive base; and an overcoat layer formed on the photosensitive layer and having a product obtained by coating an overcoat layer forming composition comprising polyaminoether and a solvent, and drying a resultant product, wherein the polyaminoether is represented by the following Formula 1:

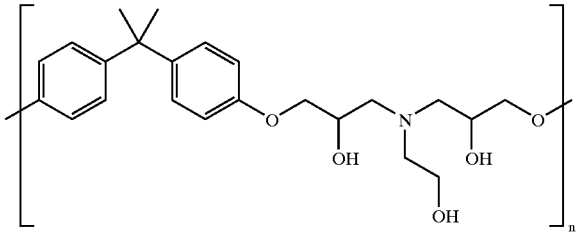

wherein n is an integer from 10 to 400, and wherein the solvent is in a range of 900 to 9900 parts by weight based on 100 parts by weight of the polyaminoether.

5. The composition of claim 1, wherein the solvent is a cosolvent including 1-methoxy-2-propanol and at least one alcoholic solvent selected from the group consisting of methanol, ethanol, propanol, butanol and isopropanol, and the alcoholic solvent is used in an amount of 1 to 30 parts by weight per 100 parts by weight of the total amount of the cosolvent.

6. The organophotoreceptor of claim 4, wherein the solvent is at least one selected from the group consisting of 1-methoxy-2-propanol, methanol, ethanol, propanol, butanol and isopropanol.

7. The organophotoreceptor of claim 4, wherein the drying is performed at a temperature in a range of 80 to 140° C.

8. The organophotoreceptor of claim 4, wherein the overcoat layer has a thickness of 0.1 to 10 $\mu$m.

9. The organophotoreceptor of claim 8, wherein the photosensitive layer has one of a single layered structure having a charge generating material and a charge transport material, and a dual-layered structure having a charge generating layer that includes the charge generating material and a charge transport layer that includes the charge transport material.

10. An electrophotographic imaging process to develop the organophotoreceptor of claim 4 using one of a dry-type toner and a wet-type toner.

11. An organophotoreceptor cartridge of an image forming apparatus, the cartridge having an electrophotographic organophotoreceptor with an overcoat layer installed therein, the organophotoreceptor cartridge comprising:

an electrophotographic organophotoreceptor comprising:

a conductive base;

a photosensitive layer formed on the conductive base; and an overcoat layer formed on the photosensitive layer and having a product obtained by coating an overcoat layer forming composition comprising polyaminoether and a solvent, and drying a resultant product; and at least one of:

a charging device that charges the electrophotographic organophotoreceptor;

a developing device that develops an electrostatic latent image formed on the electrophotographic organophotoreceptor; and a cleaning device which cleans a surface of the electrophotographic organophotoreceptor, wherein the organophotoreceptor cartridge is attachable to and detachable from the image forming apparatus, wherein the polyaminoether is represented by the following Formula 1:

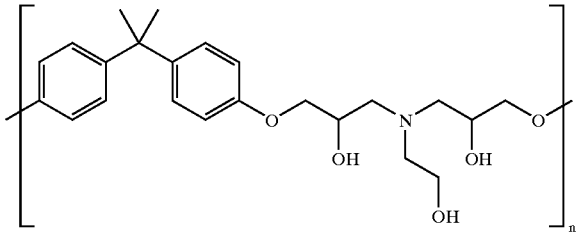

wherein n is an integer from 10 to 400, and wherein the solvent is in a range of 900 to 9900 parts by weight based on 100 parts by weight of the polyaminoether.

12. The organophotoreceptor cartridge of claim 11, wherein the thickness of the overcoat layer is 0.3 to 1 $\mu$m.

13. The organophotoreceptor cartridge of claim 11, wherein the solvent is at least one selected from the group consisting of 1-methoxy-2-propanol, methanol, ethanol, propanol, butanol and isopropanol.

14. An organophotoreceptor drum for an image forming apparatus, comprising:

a drum having an electrophotographic organic photoreceptor installed thereon, wherein the electrophotographic organic photoreceptor comprises:

an electrophotographic organic photoreceptor comprising:

a conductive base coated on the drum;

a photosensitive layer formed on the conductive base; and an overcoat layer formed on the photosensitive layer and having a product obtained by coating an overcoat layer forming composition comprising polyaminoether and a solvent, and drying a resultant product, wherein the drum is attachable to and detachable from the image forming apparatus, wherein the polyaminoether is represented by the following Formula 1:

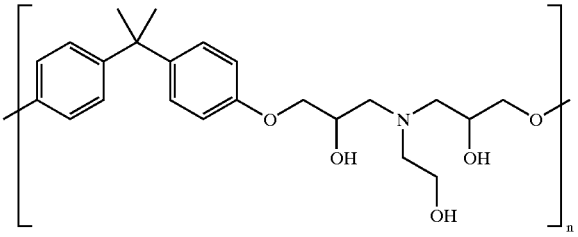

wherein n is an integer from 10 to 400, and wherein the solvent is in a range of 900 to 9900 parts by weight based on 100 parts by weight of the polyaminoether.

15. The organophotoreceptor drum of claim 14, wherein the thickness of the overcoat layer is 0.3 to 1 $\mu$m.

16. The organophotoreceptor drum of claim 14, wherein the solvent is at least one selected from the group consisting of 1-methoxy-2-propanol, methanol, ethanol, propanol, butanol and isopropanol.

17. An image forming apparatus comprising:

a photoreceptor unit comprising an electrophotographic organophotoreceptor, the photoreceptor unit comprising:

a conductive base;

a photosensitive layer formed on the conductive base; and an overcoat layer formed on the photosensitive layer and having a product obtained by coating an overcoat layer forming composition comprising polyaminoether and a solvent, and drying a resultant product;

a charging device which charges the photoreceptor;

an imagewise light irradiating device/developing device which irradiates the charged photoreceptor unit with imagewise light to form an electrostatic latent image on the photoreceptor unit;

a developing device which develops the electrostatic latent image with a toner to form a toner image on the photoreceptor unit; and a transfer device which transfers the toner image onto a receiving material, wherein the polyaminoether is represented by the following Formula 1:

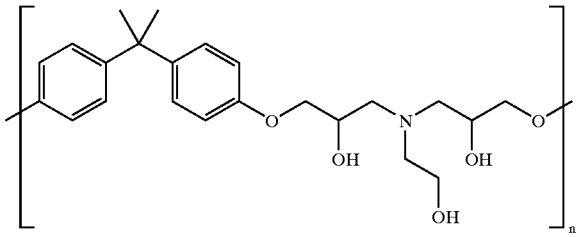

wherein n is an integer from 10 to 400, and wherein the solvent is in a range of 900 to 9900 parts by weight based on 100 parts by weight of the polyaminoether.

18. The image forming apparatus of claim 17, wherein the thickness of the overcoat layer is 0.3 to 1 $\mu$m.

19. The image forming apparatus of claim 17, wherein the solvent is at least one selected from the group consisting of 1-methoxy-2-propanol, methanol, ethanol, propanol, butanol and isopropanol.

* * * * *